United States Patent [19]

Marletta

[11] Patent Number: 4,542,445

[45] Date of Patent: Sep. 17, 1985

[54] ELECTRIC LIGHT BALLOON

[75] Inventor: Michael Marletta, Bronx, N.Y.

[73] Assignee: Louis J. Castaldo, Bronx, N.Y.

[21] Appl. No.: 567,934

[22] Filed: Jan. 3, 1984

[51] Int. Cl.[4] ..... F21V 33/00; F21V 17/02

[52] U.S. Cl. ..... 362/96; 362/206; 362/320; 362/363; 362/295; 446/224; 446/485

[58] Field of Search ..... 362/320, 96, 253, 363, 362/102, 295, 206; 46/88; 200/1 B, 85 R, 155 R; 446/485, 224, 220, 484

[56] References Cited

U.S. PATENT DOCUMENTS

| | | | |
|---|---|---|---|
| 259,115 | 6/1882 | Dyer et al. | 446/485 |
| 285,944 | 10/1983 | Applegate | 200/85 R |
| 287,758 | 10/1983 | Dyer et al. | 200/85 R |
| 1,229,794 | 6/1917 | Salzer | 362/253 |
| 1,334,835 | 3/1920 | Bryant | 362/206 |
| 1,530,923 | 3/1925 | Anns | 46/88 |
| 2,871,343 | 1/1959 | Whitney | 46/88 |
| 3,066,440 | 12/1962 | Van Dam | 46/88 |
| 4,292,999 | 10/1981 | Szollmann | 46/88 X |

FOREIGN PATENT DOCUMENTS

| | | | |
|---|---|---|---|
| 7917457 | 2/1981 | France | 46/88 |

*Primary Examiner*—Stephen C. Bentley
*Assistant Examiner*—John S. Maples
*Attorney, Agent, or Firm*—Richard L. Miller

[57] ABSTRACT

An electric light balloon containing a balloon, a housing for insertion into the balloon, access for inflation, illumination device, power supply, and a way for activating the system wherein the housing contains an orifice at its top end directly in line with the longitudinal axis of the balloon to allow direct light to enter the balloon from the bulb.

1 Claim, 4 Drawing Figures

ELECTRIC LIGHT BALLOON

BACKGROUND OF THE INVENTION

The present invention relates to an electric light balloon. More particularly it relates to an electric light balloon which contains a balloon, a housing, for insertion into the balloon, access for inflation, illumination device, power supply, and a way of activating the system.

Electric light balloons of the above mentioned general type are known in the art. One such electric light balloon is disclosed, for example, in U.S. Pat. No. 1,229,794 to Salzer. In this electric light balloon an illuminating member carries an incandescent electric lamp, the bulb of which projects at the upper end thereof. This illuminating member may comprise a battery, and is provided at its lower end with a screw threaded neck which engages the flange of the thimble and the screw threaded cap fits the neck and closes the lower end of the casing of the illuminating member. A set screw extends through the closed end of the cap into the neck and may be screwed into and out of contact with the lower end of the battery contained in the illuminating member. The electric circuit is closed through the screw, cap and thimble. This arrangement affords a very unsuitable device for activating the illumination easily and conventionally. Furthermore, to inflate the balloon, using the inflating tube the illuminating element must be removed. The battery is then fitted into place and by turning the set screw the electric bulb may be lighted. It is therefore necessary to partial disassemble the device prior to its inflation, and then subsequent to its inflation reassemble the lighting apparatus.

SUMMARY OF THE INVENTION

Accordingly, it is an object of the present invention to provide an electric light balloon which avoids the disadvantages of the prior art.

More particularly, it is an object of the present invention to provide an electric light balloon which is easy to inflate, easy to handle, and affords a variety of modes for its lighting, such as blinking, constant stay on, etc. which can all be controlled from a thumb operative switch mounted to the handle which is hand held.

In keeping with these objects, and with others which will become apparent hereafter, one feature of the present invention resides, briefly stated, in an electric light balloon containing a balloon, a housing for insertion into the balloon, access for inflation, illumination device, power supply, and a way for actuating the system wherein the housing contains an orifice at its top end directly in line with the longitudinal axis of the balloon to allow direct light to enter the balloon from the bulb.

In accordance with another feature of the present invention, a valve directs the air into the balloon from an orifice disposed on the periphery of the housing.

Still another feature of the present invention is that there is a pivotally mounted switch affixed on the surface of the handle that fits into the hand.

Finally, still a further feature of the present invention is that there is available a replacement switch affixed on the surface of the handle that could cause the bulb to blink.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENT

Figure 1:
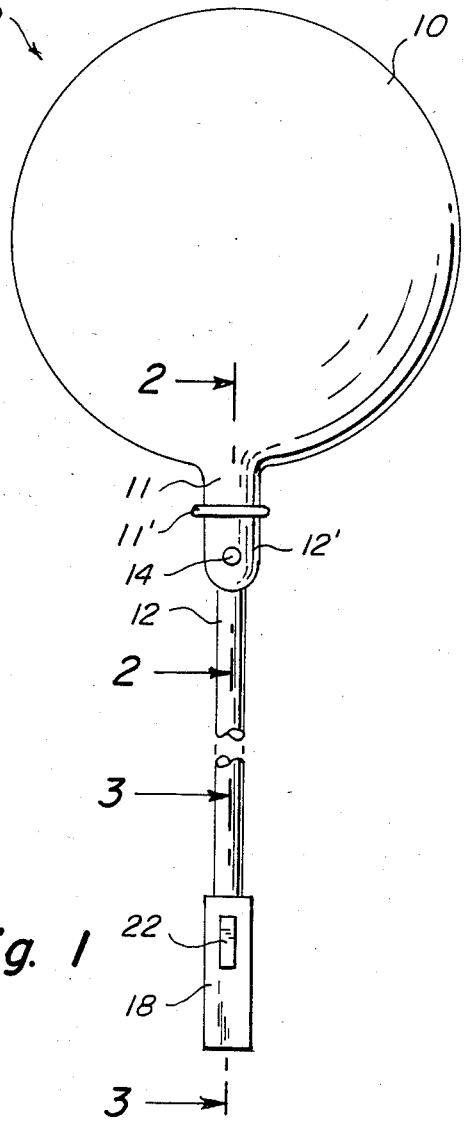
FIG. 1 is an elevational plan view of the invention.

Referring now to the figures, the electric light balloon is shown generally at 9 including a balloon 10. The balloon is composed of rubber or other suitable material and is provided with a neck 11 having a bead 11' at its lower end. A tubular member 12, having a housing 12' at it upper end serves many purposes. It supports the balloon 10, it provides a vessel for inflating balloon 10, it provides a conduit for the electrical circuitry, and is a lamp holder. The housing 12' has an orifice **13*a* at its side to receive thumb knurl valve 14 adapted to open and close orifice 13*a* for inflation and deflation of balloon 10. The housing 12' has a second orifice 13*b* at its top. Internal to housing 12' there is an illuminating member 19 which carries a bulb 23. The bulb 23 is connected to a 9 V battery 24 through wires 24*a* and 24*b* which are snaked through the tubular member 12. At the base of the tubular member 12 there is provided a second housing 18 in which the battery 24** is contained.

Figure 3:
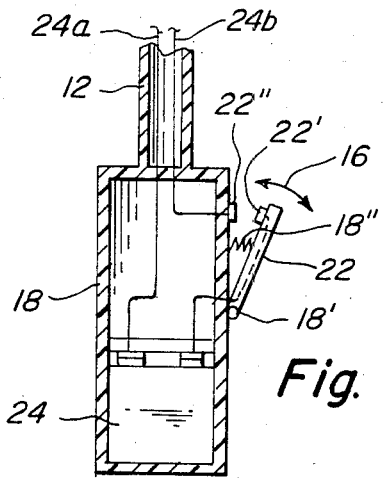
FIG. 3 is an enlarged cross sectional view taken along line 3—3 of FIG. 1.

As shown in FIG. 3, housing 18 is provided with a pivotally mounted, spring biased switch 22. Switch 22 is pivotally mounted at 18' and is biased by spring 18''. The pivotal, spring biased motion of switch 22 is readily adaptable for operation by user's thumb while housing 18 fits well into user's palm. Switch 22 connects wire **24*b* and one terminal of battery 24 when contact point 22' on the end of switch 22 touches contact point 22'' on the housing 18, thereby completing a circuit and hence lighting bulb 23. Arrow 16 shows the directional movement of switch 22**.

Figure 2:
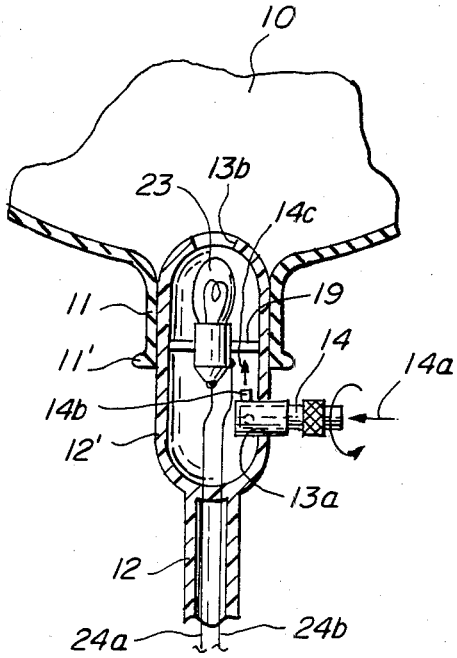
FIG. 2 is an enlarged cross sectional view taken along line 2—2 of FIG. 1.

As in FIG. 2 the second orifice **13*b* of housing 12' projects into the balloon 10 and provides a directed path for light rays of bulb 23 to illuminate balloon 10**.

In use, the housing 12' of tubular member 12 is inserted into neck 11 of the balloon 12 with the illuminating bulb 23 supported by element 19. Valve 14 is then opened to receive air from the human mouth or in large quantities by mechanical means such as a pump. The air enters valve 14 at point **14*a* and is directed through valve 14 and exited through orifice 14*b*. The air flow 14*c* is displaced in a direction perpendicular to that of 14*a* and parallel to the longitudinal axis of the electric light balloon. As the air leaves orifice 14*b* in the direction of 14*c* it passes through hole 13*b* of housing 12' and proceeds to inflate the balloon 10**.

By activating switch 22 bulb 23 may be lighted, and thus illuminating the inflated balloon 10. Any suitable ornamentation may be applied to the balloon in the usual manner, such as faces, advertising material or the like. It is thus apparent that the balloon 10 can be inflated and deflated through valve 14 without removing any of the structural or electrical elements of the device.

It should also be noted that because the bulb 23 is in direct contact with the air which maintains the balloon inflated that the heat from the bulb will cause the balloon to increase its size when the bulb is lighted and to conversely to decrease its size when the bulb is not lighted.

Figure 4:
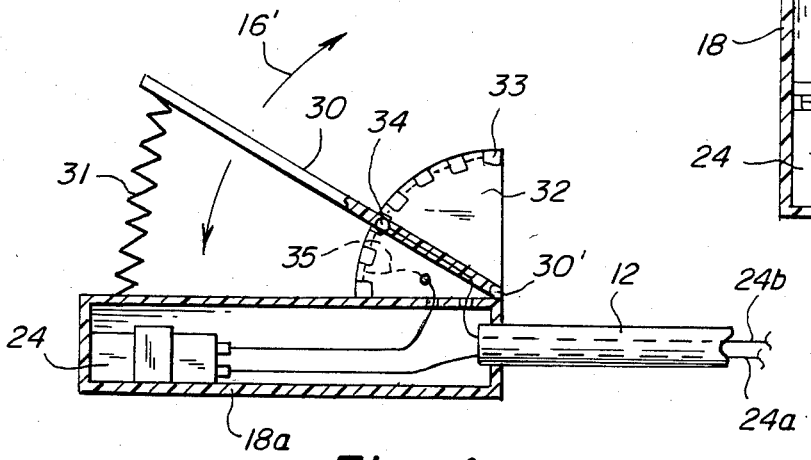
FIG. 4 is a diagrammatic cross sectional view of another embodiment of the switch portion of the invention.

A modified version of the switch 22 is shown in FIG. 4 which provides a blinking effect to bulb 23. Mounted to housing 18*a* is a plate 32 in the configuration of a quarter circle. Along the periphery of plate 32 are contact points 33. Attached to the contact points 33 is a wire 35 which is connected to battery 24. Arm 30 is pivotally mounted and spring biased to housing 18*a*. Arm 30 is pivoted at point 30' and biased by spring 31. When arm 30 moves in the direction of arrows 16', contact point 34 which is fixed to the arm and carried wire 24*b* from the bulb 23 is intermittently connected to the contact points 33. Thus the circuit is intermittently opened and closed and therefor causes bulb 23 to blink.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

I claim:

1. An electric light balloon, comprising a balloon, an elongated first housing containing a side and a top end adapted for insertion into said balloon; said first housing containing a first orifice at said top end in line with a longitudinal axis of said first housing, said first housing containing a second orifice at said side of said housing; a tubular hollow member having two ends, one end being rigidly attached to said first housing; a bulb mounted rigidly to said first housing and extending along said longitudinal axis wherein the light from said bulb passes through said first orifice so that said balloon can be illuminated; a valve inserted through said second orifice on said side of said first housing for inflating said balloon, said valve directing the incoming air upwardly along said longitudinal axis, said incoming air entering from a direction perpendicular to said longitudinal axis and then passing along said bulb and exiting into the balloon from said first orifice, whereby said bulb is in direct contact with said air which keeps said balloon inflated whereby heat transferred to said air will cause further increase in the size of said balloon due to the expansion of said air when said bulb is lit, and decrease the size of said balloon when said bulb is not lit, battery means for energizing said bulb, and a switch means for illuminating said bulb from said battery, further comprising a second housing mounted on the other end of said tubular member opposite the end where said first housing is mounted, wherein said switch means is mounted on said second housing, wherein said switch means comprises a rod containing a contact point pivotally mounted on said second housing; said rod containing a spring biasing means; so that an open and closed position can be effected to illuminate said bulb of said balloon, wherein said switch means further comprises a plate containing a set of contact points, wherein said plate is mounted to said second housing in a plane which is coplaner to that of the direction of travel of said rod, so that as said rod traverses the contact points of said plate, said bulb will intermittently blink.

* * * * *